US011879329B2

(12) United States Patent
Xue et al.

(10) Patent No.: US 11,879,329 B2
(45) Date of Patent: Jan. 23, 2024

(54) PURE MECHANICAL WELL DEVIATION WIRELESS MEASUREMENT-WHILE-DRILLING AND MUD PULSE GENERATION DEVICE

(71) Applicant: CHINA UNIVERSITY OF GEOSCIENCES (BEIJING), Beijing (CN)

(72) Inventors: Qilong Xue, Beijing (CN); Jun Qu, Beijing (CN); Jin Wang, Beijing (CN); Yifan Hu, Beijing (CN); Jintao Lu, Beijing (CN)

(73) Assignee: CHINA UNIVERSITY OF GEOSCIENCES (BEIJING), Beijing (CN)

( * ) Notice: Subject to any disclaimer, the term of this patent is extended or adjusted under 35 U.S.C. 154(b) by 0 days.

(21) Appl. No.: 17/818,385

(22) Filed: Aug. 9, 2022

(65) Prior Publication Data

US 2023/0366313 A1 Nov. 16, 2023

(30) Foreign Application Priority Data

May 12, 2022 (CN) ..... 202210516750.9

(51) Int. Cl.
*E21B 47/24* (2012.01)
*E21B 47/0236* (2012.01)

(52) U.S. Cl.
CPC ..... *E21B 47/24* (2020.05); *E21B 47/0236* (2020.05); *E21B 2200/04* (2020.05)

(58) Field of Classification Search
CPC ..... E21B 47/02; E21B 47/0236; E21B 47/12; E21B 47/14; E21B 47/18; E21B 47/20; E21B 47/22; E21B 47/24; E21B 2200/04
See application file for complete search history.

(56) References Cited

U.S. PATENT DOCUMENTS 3,014,282 A * 12/1961 Wist ..... E21B 47/022 33/312
8,528,219 B2 * 9/2013 Barnes ..... G01C 9/10 33/304

FOREIGN PATENT DOCUMENTS

CN 113756788 A * 12/2021 ..... E21B 47/022

* cited by examiner

*Primary Examiner* — Franklin D Balseca
(74) *Attorney, Agent, or Firm* — Nolte Lackenbach Siegel

(57) ABSTRACT

The pure mechanical well deviation wireless measure-while-drilling and mud pulse generation device includes an outer cylinder and an inner cylinder coaxially arranged inside the outer cylinder; an inner flow channel is formed inside the inner cylinder, and an outer flow channel is formed between the inner cylinder and the outer cylinder; a flow control valve and a hydraulic turbine are arranged in the inner flow channel, and the flow control valve is located at an upstream section of the hydraulic turbine. The device further includes a signal generation base and a rotary stopper. An overflow hole is formed on the signal generation base and arranged in the annular outer flow channel, and the rotary stopper can periodically shield the overflow hole. The inclinometer includes the pure mechanical well deviation wireless measure-while-drilling and mud pulse generation device, an inclinometer outer cylinder and an eccentric rotary column.

17 Claims, 7 Drawing Sheets

PURE MECHANICAL WELL DEVIATION WIRELESS MEASUREMENT-WHILE-DRILLING AND MUD PULSE GENERATION DEVICE

CROSS REFERENCE TO RELATED APPLICATION

This patent application claims the benefit and priority of Chinese Patent Application No. 202210516750.9 filed on May 12, 2022, the disclosure of which is incorporated by reference herein in its entirety as part of the present application.

TECHNICAL FIELD

The present disclosure relates to the technical field of logging devices, and in particular relates to a pure mechanical well deviation wireless measure-while-drilling and mud pulse generation device.

BACKGROUND ART

In the exploration process of oil and gas, geothermal resources, it is inevitable to face high temperature and pressure and other harsh underground working conditions. When the temperature is higher than 200° C., the existing traditional electronically-controlled measurement-while-drilling tool is very prone to failure in a high temperature environment due to the temperature resistance of their internal electrical components and materials, leading to influence on the drilling progress. Moreover, the tool can only be used to perform single-point measurement than measurement while drilling, leading to great increase of the construction cost.

The mechanical measurement-while-drilling tool has the advantages of high temperature resistance and high reliability compared to the electrically-controlled while-drilling measurement tool. However, in the traditional mechanical inclinometer, for example, in Chinese patent CN200510042035.2, a mechanical wireless while-drilling inclinometer is provided, a pulse generator of the inclinometer is a conventional pendulum type, which reflects different well deviation parameters by generating different numbers of mud pulse signals. But the mud pump needs to be turned off when this instrument is used for measurement while drilling, which affects the drilling efficiency; and only the number of pulse signals is used as the characteristic carrier for signal transmission, leading to weak information carrying capacity.

In Chinese patent CN202111210559.3, a mechanical while-drilling well deviation measuring instrument is disclosed, which is able to produce continuous mud pulse signal waves without turning off the mud pump. However, the continuous waves of the mud pulse signal generated by the measuring instrument have consistent amplitude, and the well deviation parameter is only reflected by means of the wave frequency, leading to weak signal bearing capacity; and the maximum well deviation measurement angle is 17°, which cannot realize the measurement of a horizontal directional well and a near horizontal well.

SUMMARY

An objective of the present disclosure is to provide a pure mechanical well deviation wireless measure-while-drilling and mud pulse generation device to solve the problems in the prior art. The device can generate continuous pulse waves of mud pressure with different amplitudes and frequency values.

In order to achieve the objective above, the present disclosure provides a pure mechanical well deviation wireless measure-while-drilling and mud pulse generation device. The device includes an outer cylinder and an inner cylinder coaxially arranged inside the outer cylinder. An inner flow channel is formed inside the inner cylinder, and an annular outer flow channel is formed between the inner cylinder and the outer cylinder; a flow control valve and a hydraulic turbine are arranged inside the inner flow channel, and the flow control valve is located at an upstream section of the hydraulic turbine.

The device further includes a signal generation base arranged between the outer cylinder and the inner cylinder, and a rotary stopper assembled with the hydraulic turbine. An overflow hole is formed in the signal generation base and arranged in the annular outer flow channel; and when the hydraulic turbine drives the rotary stopper to rotate, the rotary stopper periodically shields the overflow hole so as to change overflow area of the outer flow channel.

In some embodiments, the flow control valve includes a control module, a distributing valve seat, and a distributing valve element assembled into the distributing valve seat. An upper valve hole is formed in the distributing valve element, and a lower valve hole is formed in the distributing valve seat; when the upper valve hole overlaps the lower valve hole, the inner flow channel is communicated; and the control module is used for moving the valve element so as to change overlapping area of the upper valve hole and the lower valve hole.

In some embodiments, a valve seat sealing surface of the distributing valve seat is a cylindrical surface, a valve element sealing surface of the flow distributing valve element is a cylindrical surface, and the distributing valve element rotates along an attaching surface between the valve seat sealing surface and the valve element sealing surface. A first upper valve hole, a second upper valve hole and a third upper valve hole are sequentially formed on the valve element sealing surface in a circumferential direction thereof, and a width of the first upper valve hole, a width of the second upper valve hole and a width of the third upper valve hole are not equal to one another.

In some embodiments, in the circumferential direction of the valve element sealing surface: a bottom edge of the first upper valve hole is flush with a top edge of the second upper valve hole, a bottom edge of the second upper valve hole is flush with a top edge of the third upper valve hole, and a radian of the first upper valve hole, a radian of the second valve hole and a radian of the third upper valve hole are different from one another.

In a width direction of the valve element sealing surface: the first upper valve hole, the second upper valve hole and the third upper valve hole are arranged at intervals; in a width direction of the valve seat sealing surface, a first lower valve hole, a second lower valve hole and a third lower valve hole are arranged at intervals. The first lower valve hole and the first upper valve hole have corresponding and equal widths, the second lower valve hole and the second upper valve hole have corresponding and equal widths, and the third lower valve hole and the third upper valve hole have corresponding and equal widths. Top edges of the first lower valve hole, the second lower valve hole and the third lower valve hole are flush with one another, and bottom edges thereof are flush with one another; and the distributing valve seat is further provided with a communicating groove for connecting a respective one of the first lower valve hole, the second lower valve hole and the third lower valve hole to the inner flow channel.

In some embodiments, the control module includes an eccentric block, and the eccentric block is fixedly connected to the distributing valve element.

In some embodiments, an angle formed between a first plane through a top edge of the first upper valve hole and a circle center axis of the valve element sealing surface, and a second plane through a bottom edge of the third upper valve hole and the circle center axis of the valve element sealing surface is 90 degrees.

In some embodiments, the signal generation base is fixedly connected to the outer cylinder, and a plurality of overflow holes are provided and distributed in a circumferential array.

In some embodiments, the device further includes a turbine mounting base, the rotary stopper is fixed to a periphery of the turbine mounting base, and a top surface of the rotary stopper is in close contact with a bottom surface of the overflow hole.

The present disclosure also provides an inclinometer. The inclinometer includes any one of the pure mechanical well deviation wireless measure-while-drilling and mud pulse generation devices above; and an inclinometer outer cylinder and an eccentric rotary column. The outer cylinder of the device is fixedly connected to the inclinometer outer cylinder, the eccentric rotary column is coaxially and rotationally arranged inside the outer cylinder, the eccentric rotary column is coaxially and fixedly connected to the flow control valve, and a gravity control module is arranged in the flow control valve.

In some embodiments, the eccentric rotary column includes a first rotary column part and a second rotary column part having different weights, and the first rotary column part and the second rotary column part are arranged around an axis of the eccentric rotary column.

Compared with the prior art, the present disclosure has the following beneficial effects.

The device provided by the present disclosure generates continuous pulse waves of mud pressure with different amplitudes and frequency values. Specifically, during the drilling operation, the mud flows into the device, part of the mud enters the inner flow channel to be regulated by the flow control valve and then drives the hydraulic turbine to rotate, and the other part of the mud enters the outer flow channel; afterwards, the mud in the inner flow channel and the mud in the outer flow channel are combined to flow to a drill bit at the bottom of a drill pipe. The valve is able to change the output flow rate according to the change of drilling parameters, thus outputting different flow rates to the hydraulic turbine at a downstream section. Due to different flow rates of the drilling fluid in the inner flow channel, the rotational speed of the hydraulic turbine also changes, and the speed at which the hydraulic turbine drives the rotary stopper to rotate to block the overflow hole may also change, leading to the change of a plurality of parameters such as the frequency, period and amplitude of the continuous wave of the pulse signal; and the signal waveforms corresponding to different cases have multi-characteristic differences, so that the process of aboveground signal identification is more efficient and agile. The pulse signal generated by the device originates from the rise of mud pressure after the blockage of the overflow hole, which is a positive pulse signal having the advantages of long transmission distance and strong anti-interference ability. The present disclosure further provides an inclinometer with a purely mechanical structure for inclination measurement operation, which is efficient and reliable. The eccentric structure is well suited to the measurement of well deviation angle during large well deviation drilling.

BRIEF DESCRIPTION OF THE DRAWINGS

To describe the technical solutions in the embodiments of the present disclosure or in the prior art more clearly, the following briefly introduces the accompanying drawings used in the embodiments. Apparently, the accompanying drawings in the following description show merely some embodiments of the present disclosure, and a person of ordinary skill in the art may still derive other drawings from these accompanying drawings without paying creative efforts.

Figure 1:
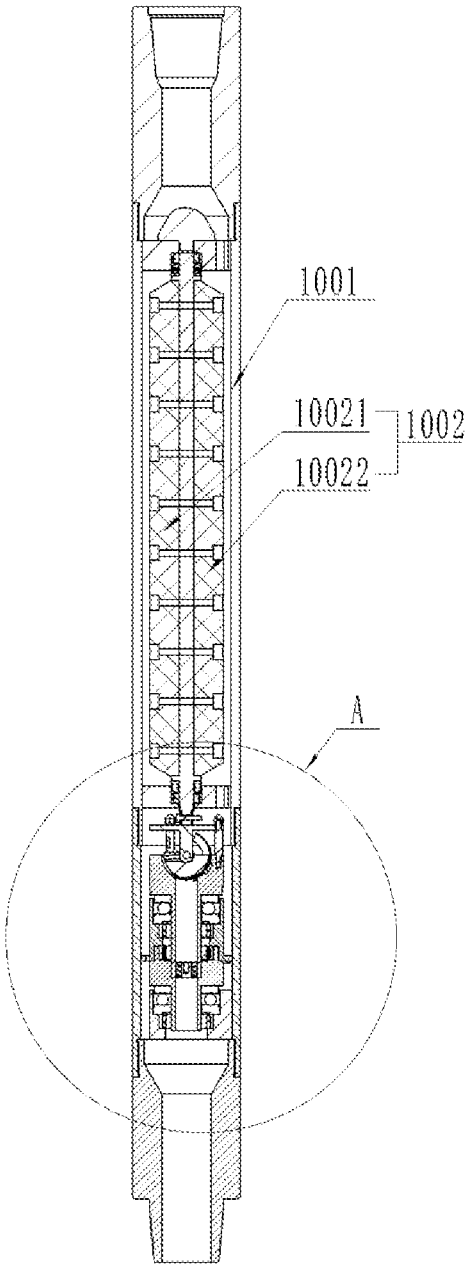
FIG. 1 is a section view of an inclinometer of the present disclosure.
Figure 2:
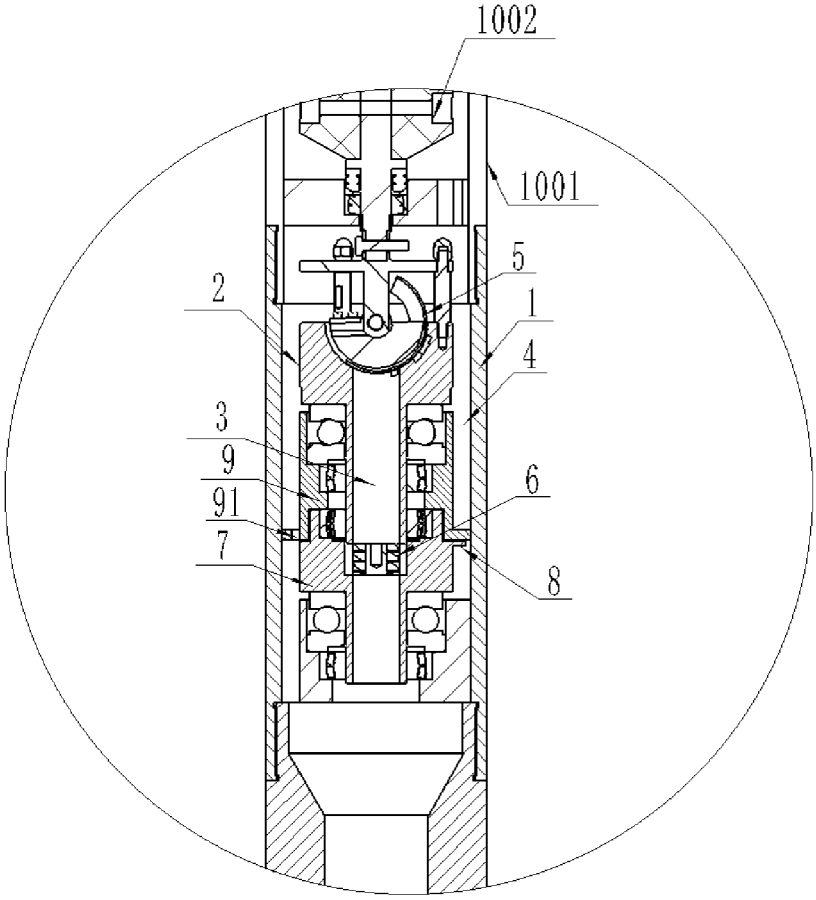
FIG. 2 is an enlarged view of A portion in FIG. 1 of the present disclosure for showing a structure of a pure mechanical well deviation wireless measure-while-drilling and mud pulse generation device.
Figure 3:
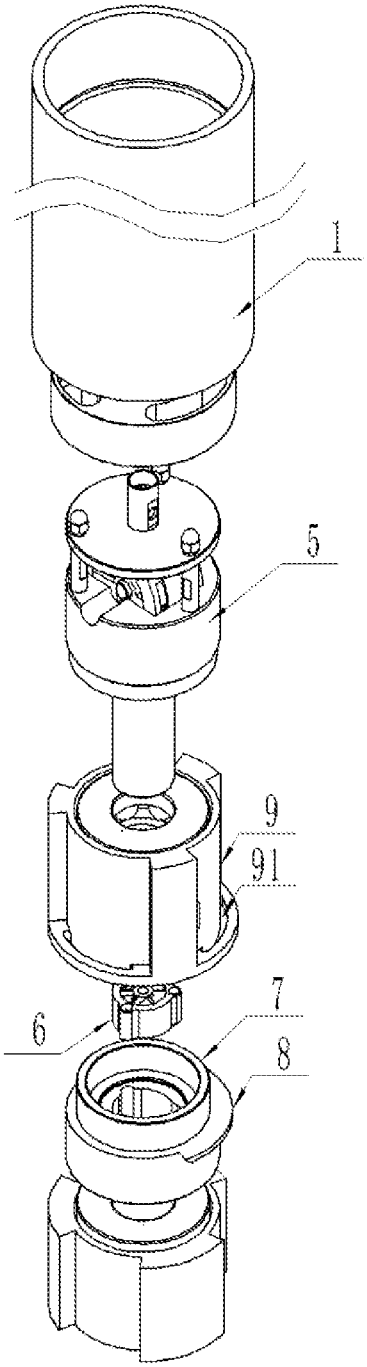
FIG. 3 is an exploded assembly diagram of the device of the present disclosure.
Figure 4:
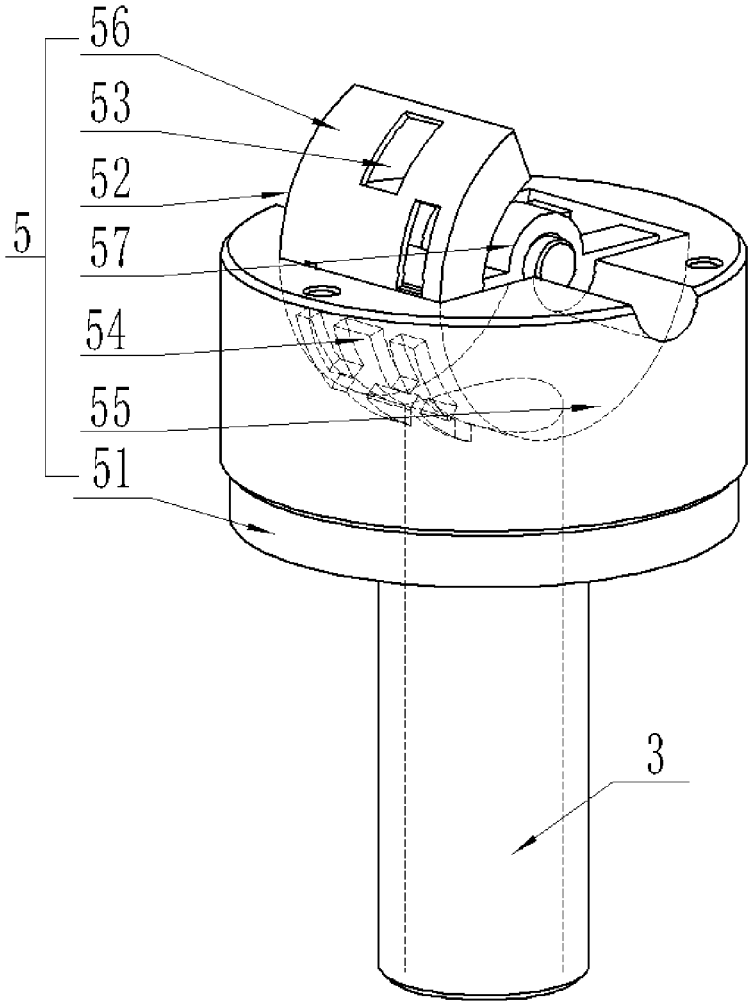
FIG. 4 is a three-dimensional diagram of a flow control valve of the present disclosure.
Figure 5:
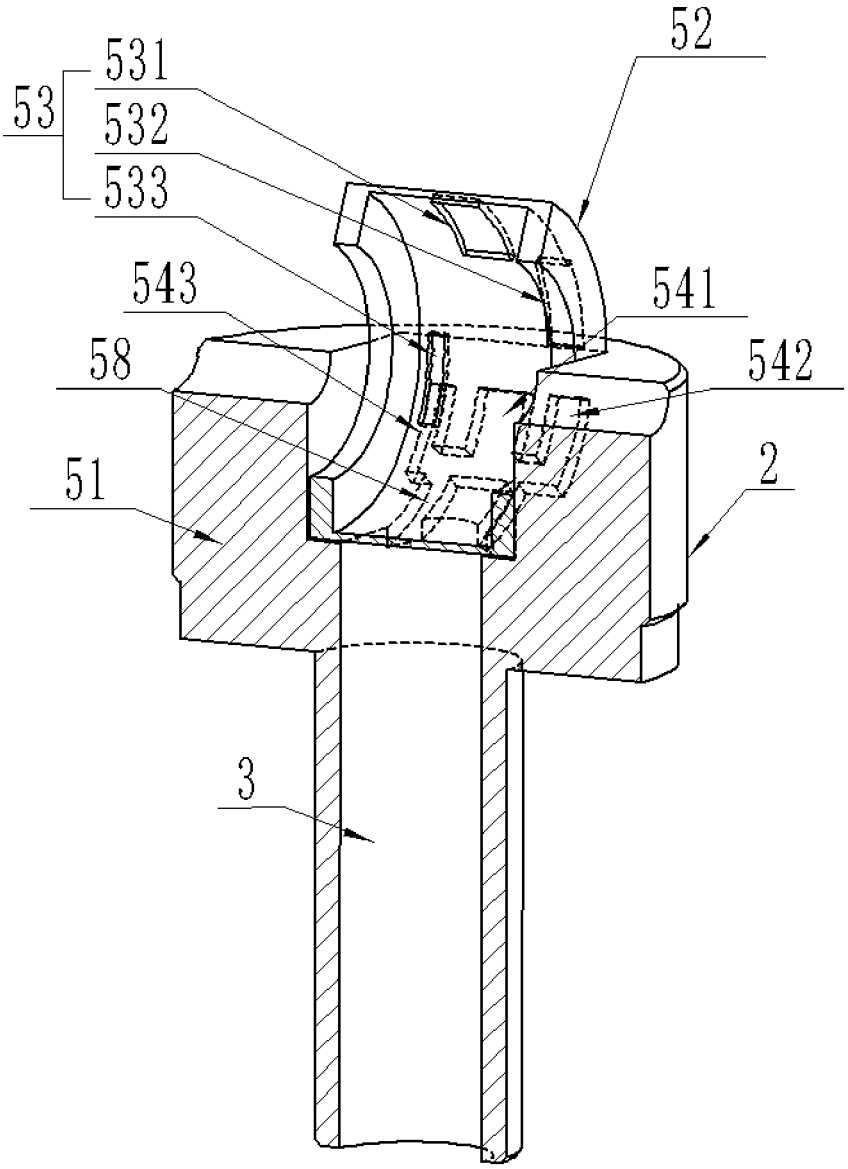
FIG. 5 is a three-dimensional profile diagram of the flow control valve of the present disclosure.
Figure 6:
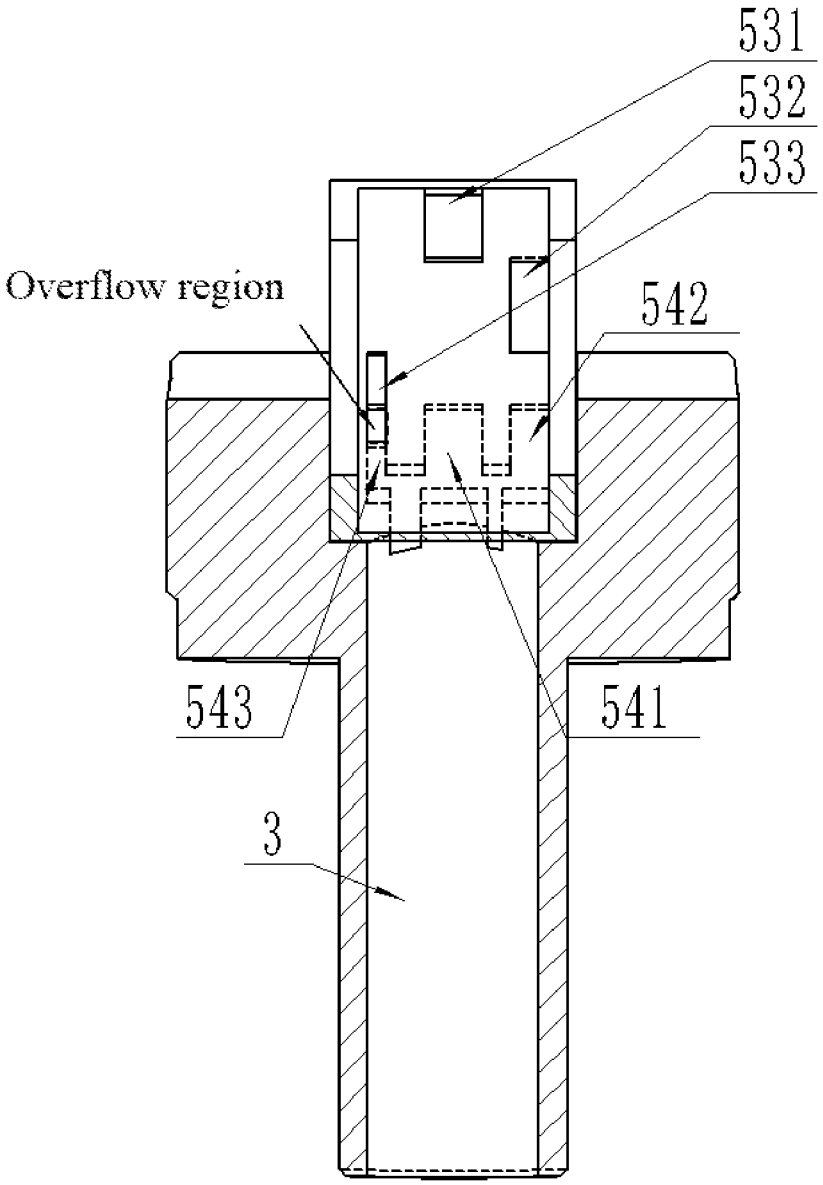
FIG. 6 is a three-dimensional sectional diagram of the flow control valve of the present disclosure.
Figure 7:
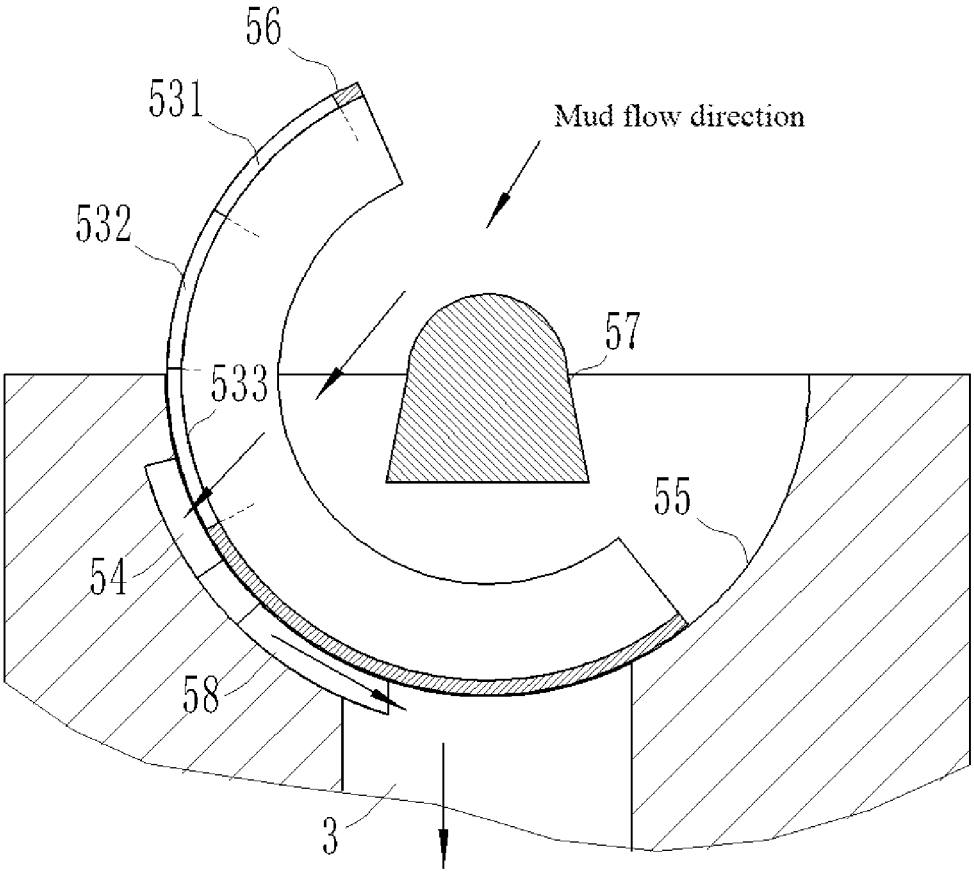
FIG. 7 is a two-dimensional sectional diagram of the flow control valve of the present disclosure for showing a flow direction of mud.

Reference numerals: 1 outer cylinder; 2 inner cylinder; 3 inner flow channel; 4 outer flow channel; 5 flow control valve; 51 distributing valve seat; 52 distributing valve element; 53 upper valve hole; 531 first upper valve hole; 532 second upper valve hole; 533 third upper valve hole; 54 lower valve hole; 541 first lower valve hole; 542 second lower valve hole; 543 third lower valve hole; 55 valve seat sealing surface; 56 valve element sealing surface; 57 eccentric block; 58 communicating groove; 6 hydraulic turbine; 7 turbine mounting base; 8 rotary stopper; 9 signal generation base; 91 overflow hole; 1001 inclinometer outer cylinder; 1002 eccentric rotary column; 10021 first rotary column part; 10022 second rotary column part

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the scope of protection of the present disclosure.

In the description of the present disclosure, it is to be understood that the terminology used herein is only for the purpose of describing particular embodiments and is not intended to be limiting. The terms "a" or "an" as used herein, are defined as one or more than one. It should be noted that, orientation or position relationships indicated by the terms "center", "upper", "lower", "left", "right", "vertical", "horizontal", "inner", "outer", etc. are orientation or position relationships shown in the accompanying drawings, or orientation or position relationships in which the product of the present disclosure is usually placed in use, only for convenience of describing the present disclosure and simplifying the description, rather than indicating or implying that the referred device or element must have a particular orientation or be constructed and operated in a particular orientation; therefore, they should not be construed as limiting the disclosure.

An objective of the present disclosure is to provide a pure mechanical well deviation wireless measure-while-drilling and mud pulse generation device to solve the problems in the prior art. The device is able to generate continuous pulse waves of mud pressure with different amplitudes and frequencies.

To make the objectives, features and advantages of the present disclosure more apparent and understandable, the following further describes the present disclosure in detail with reference to the accompanying drawings and specific embodiments.

As shown in FIG. 1 to FIG. 8, the embodiment provides a pure mechanical well deviation wireless measure-while-drilling and mud pulse generation device, which includes an outer cylinder 1 and an inner cylinder 2 coaxially arranged inside the outer cylinder 1, an inner flow channel 3 is formed inside the inner cylinder, and a gap between the inner cylinder 2 and the outer cylinder 1 forms an annular outer flow channel 4. A flow control valve 5 and a hydraulic turbine 6 are arranged in the inner flow channel 3, and the flow control valve 5 is located at an upstream section of the hydraulic turbine 6. The device further includes a signal generation base 9 and a rotary stopper 8 assembled with the hydraulic turbine 6, an overflow hole 91 is formed in the signal generation base 9 and arranged in the outer flow channel 4. When the hydraulic turbine 6 drives the rotary stopper 8 to rotate, the rotary stopper 8 is able to periodically shield the overflow hole 91 so as to change an overflow area of the outer flow channel 4.

As above, the device provided by the present disclosure is able to generate continuous pulse waves of mud pressure with different amplitudes and frequencies. Specifically, during drilling operation, the mud flows into the device, a part of the mud enters the inner flow channel 3 to be regulated by the flow control valve 5 and then drives the hydraulic turbine 6 to rotate, and the other part of the mud enters the outer flow channel 4; afterwards the mud in the inner flow channel and the mud in the outer flow channel 4 are combined to flow to a drill bit at a bottom of a drill pipe. The flow control valve 5 may be a butterfly valve and other common valves, the valve is able to change the output flow rate according to the change of drilling parameters, and the most common parameter of the drilling parameters is a value of a deviation angle. In some embodiments, a disc of the butterfly valve can be set as an inhomogeneous disc, which may be deflected by different angles to change a size of a section of the inner flow channel 3 of the valve when the well deviation angles are different, thus outputting different flow rates to the hydraulic turbine 6 at a downstream section. Due to different flow rates of the drilling fluid in the inner flow channel 3, the rotational speed of the hydraulic turbine 6 may also change, and the speed of the rotary stopper 8 driven by the hydraulic turbine 6, at which the rotary stopper 8 shield the overflow holes 91, may also change. As the drilling fluid in the outer flow channel 4 needs to penetrate through the overflow hole 91, different pressure pulse signals may be generated by the change of the area of overflow hole 91 according to a small hole overflow theory, and the change of drilling parameters can be correspondingly determined on the ground according to the change of pressure pulse signal of the mud in the well. Furthermore, different rotational speeds of the rotary stopper 8 may change the frequency and period of continuous waves of the pressure pulse signal. In a single rotating period, the different time for shielding the overflow holes 91 by the rotary stopper 8 may lead to different total flow rates of the drilling fluid passing through the overflow holes 91 within the single period, such variation may be reflected on the change of the amplitude of the pressure pulse signal continuous wave. It can be seen that the variation of drilling parameters may lead to the variation of a plurality of parameters of frequency, period and amplitude of the continuous wave of the pulse signal, and the signal waveforms corresponding to different cases have multi-characteristic differences, making the process of aboveground signal identification more efficient and agile. It is worth mentioning that the pulse signal generated by the device originates from the rise of mud pressure caused by the blockage of the overflow hole 91, which is a positive pulse signal having the advantages of long transmission distance and strong anti-interference ability. The pure mechanical well deviation wireless measure-while-drilling and mud pulse generation device is provided with the inner flow channel 3 and the outer flow channel 4; if an accident such as failure of inner parts of the device and blockage of the valves occurs, as a result, one of the inner flow channel 3 and the outer flow channel 4 is blocked; however, the drilling fluid is still kept flowing in the other of the inner flow channel 3 and the outer flow channel 4.

The furthermore technical solution is as follows.

Figure 8:
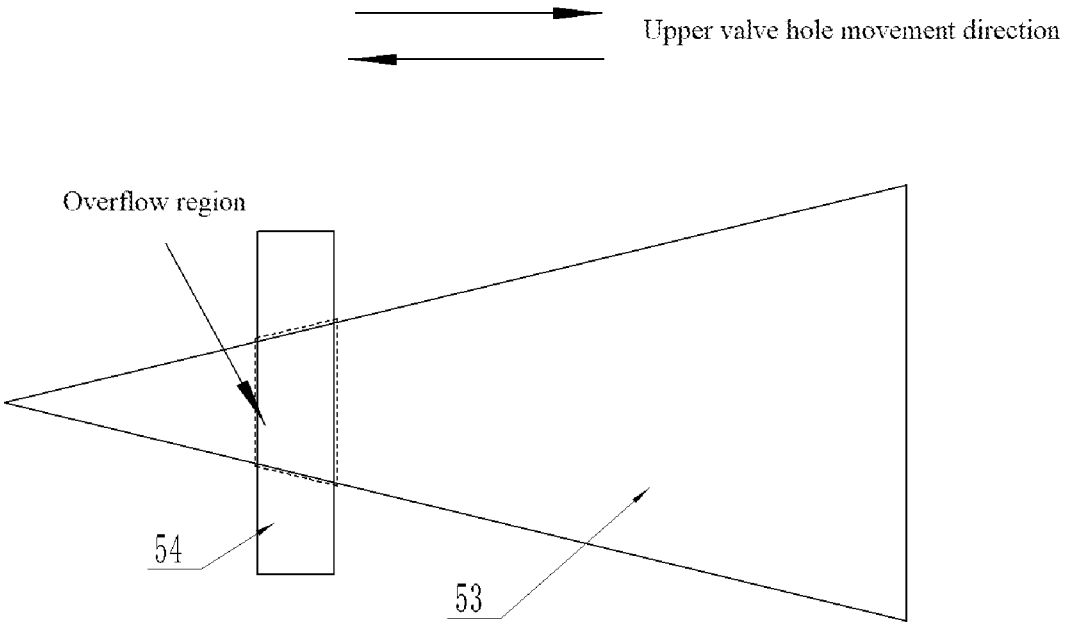
FIG. 8 is a schematic diagram of an upper valve hole and a lower valve hole of the present disclosure for showing a specific embodiment of shapes of the upper valve hole and the lower valve hole.

The flow control valve 5 includes a control module, a distributing valve seat 51, and a distributing valve element 52 assembled into a body of the distributing valve seat 51. An upper valve hole 53 is formed in the distributing valve element 52, and a lower valve hole 54 is formed in the distributing valve seat 51; and when the upper valve hole 53 overlaps the lower valve hole 54, the inner flow channel 3 is communicated. The control module is used for moving the distributing valve element 52 to change an overlapping area between the upper valve hole 53 and the lower valve hole 54. The technical feature provides a specific embodiment of the flow control valve 5; the mutual misalignment between the distributing valve seat 51 and the distributing valve element 52 changes the relative position between the upper valve hole 53 and the lower valve hole 54, and in turn changes the overlapping area between the upper valve hole and the lower valve hole 54 to regulate the output mud flow rate. Compared with the form of the previous butterfly valve, the relative position between the valve holes is easier to control, and the change of the mud flow rate is more accurate. FIG. 8 shows a specific embodiment of the shapes of the upper valve hole and the lower valve hole. A projection shape of the upper valve hole 53 can be set as a triangle or a trapezoid, and a projection shape of the lower valve hole 54 can be set as a long rectangular, such that an overlapping shape of the two valve holes is a trapezoid taking the lower valve hole 54 as the topline and baseline and taking the upper valve hole 53 as two sides. The trapezoid formed by overlapping may change as the upper valve hole 53 moves, thus changing the output mud flow rate.

A valve seat sealing surface 55 of the distributing valve seat 51 is a cylindrical surface, a valve element sealing surface 56 of the flow distributing valve element 52 is a cylindrical surface, and the distributing valve element 52 is able to rotate with respect to the distributing valve seat 51 along an attaching surface between the valve seat sealing surface 55 and the valve element sealing surface 56. A first upper valve hole 531, a second upper valve hole 532 and a third upper valve hole 533 are sequentially formed on the valve element sealing surface 56 in a circumferential direction, and the width of the first upper valve hole 531, the width of the second upper valve hole 532 and the width of the third upper valve hole 533 are not equal to one another. This technical feature gives the specific arrangement form of the upper valve hole and lower valve holes 54: three upper valve holes 53 form an upper valve hole 53 group. As the three valve holes have different widths, there is a large difference in the overlapping areas when different upper valve holes 53 overlap the lower valve hole 54 respectively, and the difference in mud flow change caused by the rotation of the distributing valve element 52 relative to the distributing valve seat 51 is more significant, thus generating mud pulse signal waves having a greater difference in waveforms to facilitate the ground personnel to compile and analyze. The number of the upper valve holes 53 can be changed according to actual conditions.

In a circumferential direction of the valve element sealing surface 56, the bottom edge of the first upper valve hole 531 is flush with the top edge of the second upper valve hole 532, the bottom edge of the second upper valve hole 532 is flush with the top edge of the third upper valve hole 533, and the radian of the first upper valve hole 531, the radian of the second upper valve hole 532 and the radian of the third upper valve hole 533 are the same. In a width direction of the valve element sealing surface 56: the first upper valve hole 531, the second upper valve hole 532 and the third upper valve hole 533 are arranged at intervals. In a width direction of the valve seat sealing surface 55, a first lower valve hole 541, a second lower valve hole 542 and a third lower valve hole 543 are arranged at intervals, the first lower valve hole 541 and the first upper valve hole 531 have corresponding and equal widths respectively, the second lower valve hole 542 and the second upper valve hole 532 have corresponding and equal widths respectively, and the third lower valve hole 543 and the third upper valve hole 533 have corresponding and equal widths respectively. The top edges and the bottom edges of the respective lower valve holes are flush with one another; and the valve seat is further provided with a communicating groove 58 for connecting respective lower valve holes 54 and the inner flow channel 3. The technical feature limits a relative position among the three upper valve holes 53. That is, in the circumferential direction of the valve seat sealing surface 55, the three upper valve holes 53 are successively connected; and in a width direction, the three upper valve holes are staggered from one another. The valve seat is provided with three lower valve holes 54 corresponding to the upper valve holes 53 correspondingly. As the three upper valve holes 53 are successively connected, within the measuring range, regardless of the rotation angle of the distributing valve element 52, there are upper and lower valve holes in corresponding overlapping, and the measurement process cannot be interrupted. Moreover, as the three upper valve holes 53 are staggered from one another and have the same radian, in the measurement process, only one upper-lower valve hole group is correspondingly through, and other non-working upper valve hole and lower valve hole are blocked by the valve element sealing surface 56 or the valve seat sealing surface 55, and flow control valve 5 can control the mud with high accuracy. In addition to the different overlapped overflow area when different upper and lower valve holes overlap, an overflow region is a region sandwiched between the bottom edge of the upper valve hole 53 and the top edge of the lower valve hole 54 when the upper and lower valve holes in single corresponding relationship overlap, and in the rotating process of the valve element, the overflow area may change as the distance between the bottom edge of the upper valve hole 53 and the top edge of the lower valve hole 54 changes, thereby enabling the device to achieve continuous measurement of the whole process.

The control module comprises an eccentric block 57 which is fixedly connected to the distributing valve element 52. Under the control of the eccentric block 57, the distributing valve element 52 always points to a direction of center of earth, and after the tilt rotation of the distributing valve seat 51, an angle between the distributing valve seat 51 and the distributing valve element 52 is a deviation angle of the well. At the moment, the upper valve hole 53 on the distributing valve element 52 and the lower valve hole 54 on the distributing valve seat 51 correspond to a specific area, the valve outputs a specific flow rate to drive the hydraulic turbine 6 to rotate according to a specific speed. The rotary stopper 8 sweeps and shields the overflow hole 91 according to a specific speed so that the mud pressure in the outer flow channel 4 changes to generate a mud pulse signal. The ground inspector then decodes and identifies the mud pulse signal to obtain the deviation angle of the well.

An angle formed between a first plane through the top edge of the first upper valve hole 531 and a circle center axis of the valve element sealing surface 56 and a second plane through the bottom edge of the third upper valve hole 533 and the circle center axis of the valve element sealing surface 56 is 90 degrees. The technical feature enables the inclination range of the pure mechanical well deviation wireless measure-while-drilling and mud pulse generation device to be from 0 degrees to 90 degrees.

Furthermore, the signal generation base 9 is fixedly connected to the outer cylinder 1. A plurality of overflow holes 91 are provided and are distributed in a circumferential array. The device further includes a turbine mounting base 7, the rotary stopper 8 is fixed to the periphery of the turbine mounting base 7, and the top surface of the rotary stopper 8 is in close contact with the bottom surface of the overflow hole 91.

The present disclosure further provides an inclinometer, which includes a pure mechanical well deviation wireless measure-while-drilling and mud pulse generation device of any one of above, and further an inclinometer outer cylinder 1001 and an eccentric rotary column 1002. The outer cylinder 1 of the device is fixedly connected to the inclinometer outer cylinder 1001, the eccentric rotary column 1002 is coaxially and rotationally arranged inside the outer cylinder 1, the eccentric rotary column 1002 is coaxially and fixedly connected to the flow control valve 5, and a gravity control module is arranged in the flow control valve 5. The inclinometer is inclined by means of the gravity control module arranged inside the flow control valve 5. In some embodiments, the gravity control module may be an eccentric block 57. The arrangement of the eccentric rotary column 1002 enables the gravity control module in the flow control valve 5 to be always located on the low side of the well, facilitating to improve stability during drilling. In this field, the bottom of a drilled well is a circular plane in an inclined state, which is called a bottom hole circle. The highest point on the bottom hole circle is called a high side, and the lowest point is called a low side. A plurality of bearing packs should be provided among the modules of the inclinometer, thus achieving separate rotation among different assemblies.

The eccentric rotary column 1002 includes a first rotary column part 10021 and a second rotary column part 10022 which have different weights, and the first rotary column part 10021 and the second rotary column part 10022 are arranged along an axis of the eccentric rotary column 1002. The technical feature provides a specific embodiment of the eccentric rotary column 1002. As the first rotary column part 10021 and the second rotary column part 10022 have different weights and the first rotary column part 10021 and the second rotary column part 10022 are arranged along an axis of the eccentric rotary column 1002, the center of gravity of the eccentric rotary column 1002 is not on the axis of the eccentric rotary column 1002. When the eccentric rotary column 1002 is inclined along a shaft wall, the own gravity of the eccentric rotary column may always generate a rotational torque on the central axis of the eccentric rotary column 1002, which is conducive to always keeping the gravity control module in the flow control valve 5 at the inclined low side of the well. Under the big hole deviation angle, the greater the deflection angle is, the greater the deflection moment generated by the eccentric rotary column 1002 is, and the greater the well deviation stability and the measurement range are.

It should be noted that: for those skilled in the art, apparently, the present disclosure is not limited to details of the exemplary embodiments, and may be expressed in other specific forms without departing from the spirit or basic characteristics of the present disclosure. Therefore, in any way, the embodiments should be regarded as exemplary, not limitative; and the scope of the present disclosure is limited by the appended claims, instead of the above description. Thus, all variations intended to fall into the meaning and scope of equivalent elements of the claims should be covered within the present disclosure. Any reference signs in the claims shall not be regarded as limitations to the concerned claims.

Several examples are used for illustration of the principles and implementation methods of the present disclosure. The description of the embodiments is merely used to help illustrate the method and its core principles of the present disclosure. In addition, a person of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A pure mechanical well deviation wireless measure-while-drilling and mud pulse generation device, comprising:

an outer cylinder and an inner cylinder coaxially arranged inside the outer cylinder, wherein an inner flow channel is formed inside the inner cylinder, and an annular outer flow channel is formed between the inner cylinder and the outer cylinder;

wherein a flow control valve and a hydraulic turbine are arranged inside the inner flow channel, and the flow control valve is located at an upstream section of the hydraulic turbine;

the device further comprises:

a signal generation base arranged between the outer cylinder and the inner cylinder; and a rotary stopper assembled with the hydraulic turbine;

wherein an overflow hole is formed in the signal generation base and arranged in the annular outer flow channel; and when the hydraulic turbine drives the rotary stopper to rotate, the rotary stopper periodically shields the overflow hole so as to change overflow area of the outer flow channel.

2. The device according to claim 1, wherein the flow control valve comprises a control module, a distributing valve seat, and a distributing valve element assembled into the distributing valve seat;

wherein an upper valve hole is formed in the distributing valve element, and a lower valve hole is formed in the distributing valve seat;

when the upper valve hole overlaps the lower valve hole, the inner flow channel is communicated; and wherein the control module is used for moving the distributing valve element so as to change overlapping area of the upper valve hole and the lower valve hole.

3. The device according to claim 2, wherein a valve seat sealing surface of the distributing valve seat is a cylindrical surface, and a valve element sealing surface of the distributing valve element is a cylindrical surface, wherein the distributing valve element rotates along an attaching surface between the valve seat sealing surface and the valve element sealing surface;

wherein a first upper valve hole, a second upper valve hole and a third upper valve hole are sequentially formed on the valve element sealing surface in a circumferential direction thereof, and a width of the first upper valve hole, a width of the second upper valve hole and a width of the third upper valve hole are not equal to one another.

4. The device according to claim 3, wherein in the circumferential direction of the valve element sealing surface:

a bottom edge of the first upper valve hole is flush with a top edge of the second upper valve hole, a bottom edge of the second upper valve hole is flush with a top edge of the third upper valve hole, and wherein a radian of the first upper valve hole, a radian of the second valve hole and a radian of the third upper valve hole are different from one another;

in a width direction of the valve element sealing surface: the first upper valve hole, the second upper valve hole and the third upper valve hole are arranged at intervals;

in a width direction of the valve seat sealing surface, a first lower valve hole, a second lower valve hole and a third lower valve hole are arranged at intervals, wherein the first lower valve hole and the first upper valve hole have corresponding and equal widths, the second lower valve hole and the second upper valve hole have corresponding and equal widths, and the third lower valve hole and the third upper valve hole have corresponding and equal widths;

wherein top edges of the first lower valve hole, the second lower valve hole and the third lower valve hole are flush with one another, and bottom edges thereof are flush with one another; and wherein the distributing valve seat is further provided with a communicating groove for connecting a respective one of the first lower valve hole, the second lower valve hole and the third lower valve hole to the inner flow channel.

5. The device according to claim 3, wherein the control module comprises an eccentric block, and the eccentric block is fixedly connected to the distributing valve element.

6. The device according to claim 5, wherein an angle formed between a first plane through a top edge of the first upper valve hole and a circle center axis of the valve element sealing surface, and a second plane through a bottom edge of the third upper valve hole and the circle center axis of the valve element sealing surface is 90 degrees.

7. The device according to claim 2, wherein the signal generation base is fixedly connected to the outer cylinder, and a plurality of overflow holes are provided and distributed in a circumferential array.

8. The device according to claim 1, further comprising a turbine mounting base, wherein the rotary stopper is fixed to a periphery of the turbine mounting base, and a top surface of the rotary stopper is in close contact with a bottom surface of the overflow hole.

9. An inclinometer, comprising a pure mechanical well deviation wireless measure-while-drilling and mud pulse generation device, an inclinometer outer cylinder and an eccentric rotary column, wherein the pure mechanical well deviation wireless measure-while-drilling and mud pulse generation device comprises an outer cylinder and an inner cylinder coaxially arranged inside the outer cylinder of the device, wherein an inner flow channel is formed inside the inner cylinder, and an annular outer flow channel is formed between the inner cylinder and the outer cylinder of the device;

wherein a flow control valve and a hydraulic turbine are arranged inside the inner flow channel, and the flow control valve is located at an upstream section of the hydraulic turbine;

the device further comprises a signal generation base arranged between the outer cylinder of the device and the inner cylinder, and a rotary stopper assembled with the hydraulic turbine;

wherein an overflow hole is formed in the signal generation base and arranged in the annular outer flow channel; and when the hydraulic turbine drives the rotary stopper to rotate, the rotary stopper periodically shields the overflow hole so as to change overflow area of the outer flow channel;

wherein the outer cylinder of the device is fixedly connected to the inclinometer outer cylinder, the eccentric rotary column is coaxially and rotationally arranged inside the inclinometer outer cylinder, the eccentric rotary column is coaxially and fixedly connected to the flow control valve, and a gravity control module is arranged in the flow control valve.

10. The inclinometer according to claim 9, wherein the eccentric rotary column comprises a first rotary column part and a second rotary column part having different weights, and wherein the first rotary column part and the second rotary column part are arranged around an axis of the eccentric rotary column.

11. The inclinometer according to claim 9, wherein the flow control valve comprises Gall the gravity control module, a distributing valve seat, and a distributing valve element assembled into the distributing valve seat;

wherein an upper valve hole is formed in the distributing valve element, and a lower valve hole is formed in the distributing valve seat;

when the upper valve hole overlaps the lower valve hole, the inner flow channel is communicated; and wherein the gravity control module is used for moving the distributing valve element so as to change overlapping area of the upper valve hole and the lower valve hole.

12. The inclinometer according to claim 11, wherein a valve seat sealing surface of the distributing valve seat is a cylindrical surface, and a valve element sealing surface of the distributing valve element is a cylindrical surface, wherein the distributing valve element rotates along an attaching surface between the valve seat sealing surface and the valve element sealing surface;

wherein a first upper valve hole, a second upper valve hole and a third upper valve hole are sequentially formed on the valve element sealing surface in a circumferential direction thereof, and a width of the first upper valve hole, a width of the second upper valve hole and a width of the third upper valve hole are not equal to one another.

13. The inclinometer according to claim 12, wherein in the circumferential direction of the valve element sealing surface:

a bottom edge of the first upper valve hole is flush with a top edge of the second upper valve hole, a bottom edge of the second upper valve hole is flush with a top edge of the third upper valve hole, and wherein a radian of the first upper valve hole, a radian of the second valve hole and a radian of the third upper valve hole are different from one another;

in a width direction of the valve element sealing surface: the first upper valve hole, the second upper valve hole and the third upper valve hole are arranged at intervals;

in a width direction of the valve seat sealing surface, a first lower valve hole, a second lower valve hole and a third lower valve hole are arranged at intervals, wherein the first lower valve hole and the first upper valve hole have corresponding and equal widths, the second lower valve hole and the second upper valve hole have corresponding and equal widths, and the third lower valve hole and the third upper valve hole have corresponding and equal widths;

wherein top edges of the first lower valve hole, the second lower valve hole and the third lower valve hole are flush with one another, and bottom edges thereof are flush with one another; and wherein the distributing valve seat is further provided with a communicating groove for connecting a respective one of the first lower valve hole, the second lower valve hole and the third lower valve hole to the inner flow channel.

14. The inclinometer according to claim 12, wherein the gravity control module comprises an eccentric block, and the eccentric block is fixedly connected to the distributing valve element.

15. The inclinometer according to claim 14, wherein an angle formed between a first plane through a top edge of the first upper valve hole and a circle center axis of the valve element sealing surface, and a second plane through a bottom edge of the third upper valve hole and the circle center axis of the valve element sealing surface is 90 degrees.

16. The inclinometer according to claim 11, wherein the signal generation base is fixedly connected to the outer cylinder of the device, and a plurality of overflow holes are provided and distributed in a circumferential array.

17. The inclinometer according to claim 9, further comprising a turbine mounting base, wherein the rotary stopper is fixed to a periphery of the turbine mounting base, and a top surface of the rotary stopper is in close contact with a bottom surface of the overflow hole.

* * * * *